United States Patent [19]

Youngbauer

[11] Patent Number: 4,621,752

[45] Date of Patent: Nov. 11, 1986

[54] NONRIGID BOW HOLSTER

[76] Inventor: Steven R. Youngbauer, 707 W. 8th St., Gillette, Wyo. 82716

[21] Appl. No.: 753,918

[22] Filed: Jul. 11, 1985

[51] Int. Cl.[4] ..... A45F 55/00

[52] U.S. Cl. ..... 224/253; 224/240; 224/250; 224/916

[58] Field of Search ..... 224/193, 222, 149, 192, 224/253, 200, 234, 235, 236, 238, 240, 242, 250, 916, 913

[56] References Cited

U.S. PATENT DOCUMENTS 3,934,768 1/1976 Jones ..... 224/253

4,006,851 2/1977 Kippen ..... 224/253

4,103,807 8/1978 Lyon et al. ..... 224/222

*Primary Examiner*—Stephen Marcus

*Assistant Examiner*—David Voorhees

[57] ABSTRACT

A holster to carry a compound bow at the waist of the archer in a nonrigid position. The holster is constructed of flexible material characterized by leather and a plastic in such a manner to form an oblong shaped pocket in which the bow handle is placed and secured by a safety strap. The bow can either be carried in a nonrigid horizontal position or tilted and secured adjacent to the archer's leg by means of a strap attached to the archer's leg. This bow holster protects the bow from expensive damage and allows unrestricted use of the hands.

2 Claims, 5 Drawing Figures

NONRIGID BOW HOLSTER

BACKGROUND OF THE INVENTION

Archery bows are widely used for hunting, field events, and target competition. Because of their design, modern compound bows are often expensive, heavy, and susceptible to damage. During use, there is a need for a mechanism to carry a compound bow in a safe position which provides quick access and allows unrestricted use of the hands.

At the present time compound bows are carried by hand, slings, hooks, spring type arms, interlock systems, or attached with a rope. These methods have many disadvantages, some of which include: lack of accessibility, drilling or attachments to the bow which can affect the bow's performance, value and beauty. Still others such as the spring type arms or an interlock system, require the bow to be held in a rigid horizontal position. These methods expose the end of the bow to permanent and expensive damage when riding horse or motorbikes, walking through trees or brush, or climbing mountains.

The present invention overcomes the shortcomings of these existing methods.

SUMMARY OF THE INVENTION

My invention allows the archer to carry a compound bow in a nonrigid position in a holster attached to a belt at the archer's waist. The holster is constructed of flexible material characterized by leather or plastic in such a manner to form an oblong pocket in which the handle of the bow is placed and secured by means of a safety strap. The bow can either be carried in a nonrigid horizontal position or tilted in the oblong pocket and attached by means of a leg strap so as to be adjacent to the archer's leg. This allows unrestricted use of the hands while carrying the bow in a safe and quickly available manner without drilling or attachments to the bow which can affect the bow's performance, value, or beauty.

It is therefore an object of this invention to provide a holster to carry a bow at the archer's waist in a nonrigid position.

It is a particular object of this invention to provide a holster constructed of flexible material characterized by leather and plastic, in such a manner as to form an oblong pocket in which the handle of a bow can be placed and secured with a quick release strap.

It is another particular object of this invention to provide a holster for placement of the bow in a nonrigid horizontal or tilted position and which secures the bow limb by means of a strap attached to the archer's leg.

It is another particular object of this invention to allow the unrestricted use of the hands while carrying the bow in a safe and quickly available manner without drilling or attachments to the bow which can affect its performance, value, or beauty.

It is still another particular object of this invention to provide a bow holster which is inexpensive, easy to manufacture, durable, adjustable to fit all sizes and makes, and will not interfere with bow sights, quivers, and stabilizers while the holster is in use.

This invention lies in the construction and arrangement of the various parts of the holster and will be better understood after reviewing the description of the invention. Other objects, features, and advantages of the invention will be apparent without departing from the spirit and scope of the invention.

DETAILED DESCRIPTION OF THE INVENTION

Figure 1:
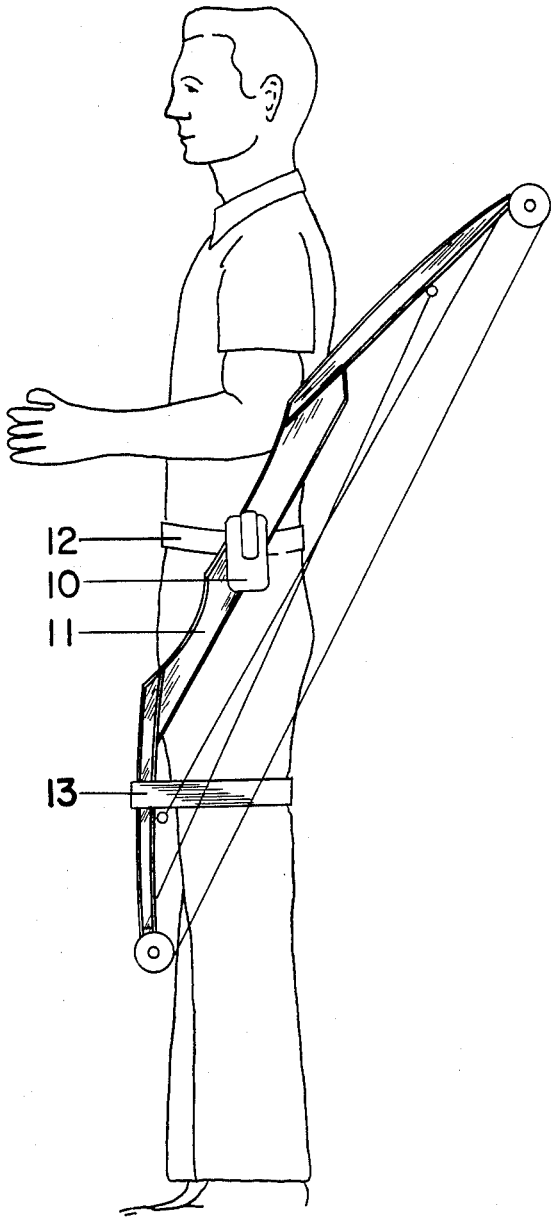
FIG. 1 is a plain view of an archer carrying a compound bow tilted in a holster at the archer's waist and secured by a leg strap.
Figure 2:
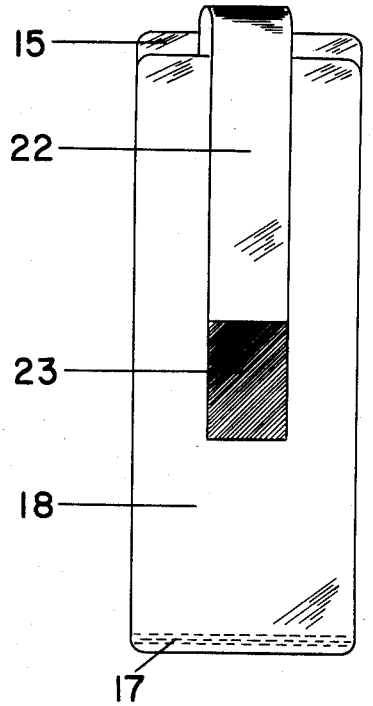
FIG. 2 is a front view of the holster.

FIG. 1 illustrates an archer carrying a compound bow (11) in a holster (10) attached to a belt (12) with the bow secured to the archer's leg by means of a leg strap (13). The holster (10) in its preferred manner is constructed of flexible material characterized by leather and plastic.

Figure 3:
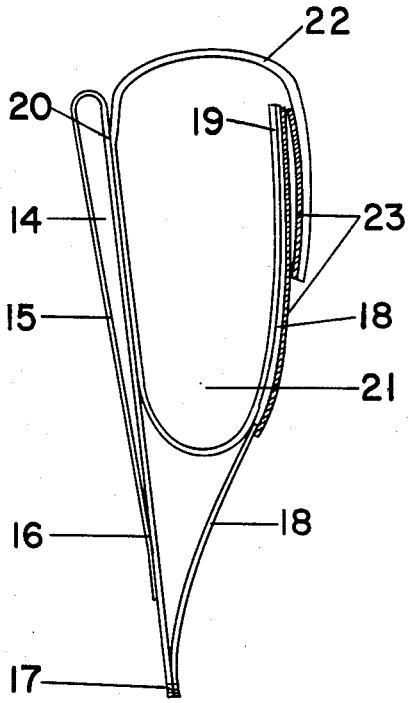
FIG. 3 is a side view of the holster.

As best demonstrated by FIG. 3, the holster (10) has a belt loop (14) which is formed by a piece of flexible material (15) of suitable length and width. One end is folded and attached to the backside of the piece (16) and the other end (17) is attached to another piece of flexible material (18) to form a "V" shaped shell.

Another piece of flexible material is attached to the end of the piece of flexible material (19) and the front side of the belt loop (20) to form an oblong shaped pocket (21). The remainder of the piece is a safety strap (22) which has a connecting means characterized by velcro or a snap attached to the end and the front portion of the holster (23). The bow handle (11) is placed in the oblong shaped pocket (21) and secured with the safety strap (22) by way of the attaching means (23).

Figure 4:
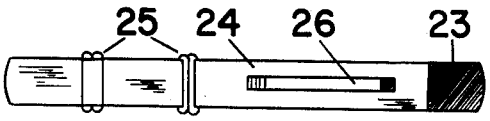
FIG. 4 is a side view of the leg strap which secures the bow adjacent to the archer's leg.
Figure 5:
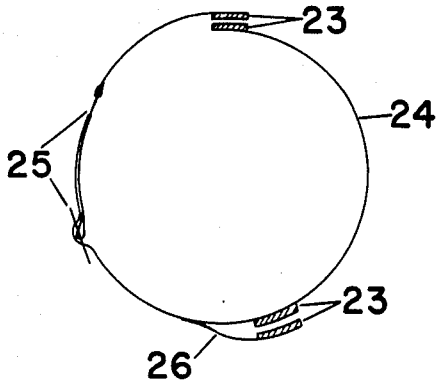
FIG. 5 is an overhead view of the leg strap.

FIG. 4 and FIG. 5 illustrate the leg strap (24). It is constructed of elastic type material with each end having a connection means (23). An adjustable buckle (25) is also provided so that the strap may be adjusted for connection around the archer's leg. Attached to the leg strap is a short piece of flexible material (26) with a connecting means on the other end (23). When the bow is tilted in the oblong pocket, the leg strap secures the bow limb adjacent to the archer's leg as illustrated by FIG. 1. The holster member may be used with or without the leg strap.

I claim as my invention:

1. A holster for carrying a compound bow in a nonrigid horizontal position at the archer's waist comprising of:

(a) a means for attachment to the archer's belt characterized by a belt loop constructed of flexible material such as leather or plastic with one piece folded and attached to itself;

(b) an oblong pocket attached to the belt loop for placement of the bowhandle constructed by attaching a second piece of flexible material to one end of the belt loop to form a "V" shaped shell and a third piece of flexible material with one end attached to the "V" shaped shell and the middle of the same piece attached to the outside of the belt loop;

(c) a safety strap to secure the bowhandle in the oblong pocket constructed by attaching a connecting means characterized by velcro or a snap to the unattached end of the third piece of flexible material and the front of the holster whereby the belt loop is attached to the archer's belt and the bowhandle is placed in the oblong pocket and secured by the safety strap.

2. A holster for carrying a compound bow in a non-rigid position at the archer's waist comprising of:

(a) a means for attachment to the archer's belt characterized by a belt loop constructed of material such as leather or plastic with one piece folded and attached to itself;

(b) an oblong pocket attached to the belt loop for placement of the bowhandle constructed by attaching a second piece of flexible material to one end of the belt loop to form a "V" shaped shell and a third piece of flexible material with one end attached to the "V" shaped shell and the middle of the same piece attached to the outside of the belt loop;

(c) a safety strap to secure the bowhandle in the oblong pocket constructed by attaching a connecting means characterized by velcro or a snap to the unattached end of the third piece of flexible material and the front of the holster;

(d) a detachable leg strap constructed of two pieces of flexible material with one piece having a connecting means on each end for placement around the leg and the second piece attached to first piece and the other end of the same piece having a connecting means for placement of the bowlimb whereby the belt loop is attached to the archer's belt, the bowhandle is placed in the oblong pocket and secured by the safety strap and the bow is tilted forward and secured next to the archer's leg by means of the detachable leg strap.

* * * * *